US011535027B2

(12) United States Patent
Behnke

(10) Patent No.: US 11,535,027 B2
(45) Date of Patent: Dec. 27, 2022

(54) METHOD AND DEVICE FOR PRINTING THE RESPECTIVE LATERAL SURFACE OF HOLLOW OBJECTS

(71) Applicant: KOENIG & BAUER AG, Würzburg (DE)

(72) Inventor: Stephan Behnke, Ahrensfelde (DE)

(73) Assignee: KOENIG & BAUER AG, Würzburg (DE)

( * ) Notice: Subject to any disclaimer, the term of this patent is extended or adjusted under 35 U.S.C. 154(b) by 0 days.

(21) Appl. No.: 17/613,160

(22) PCT Filed: Sep. 25, 2020

(86) PCT No.: PCT/EP2020/076912
§ 371 (c)(1),
(2) Date: Nov. 22, 2021

(87) PCT Pub. No.: WO2021/089236
PCT Pub. Date: May 14, 2021

(65) Prior Publication Data

US 2022/0212463 A1 Jul. 7, 2022

(30) Foreign Application Priority Data

Nov. 6, 2019 (DE) ..... 10 2019 129 926.8

(51) Int. Cl.
*B41F 17/22* (2006.01)
*B41F 33/00* (2006.01)

(52) U.S. Cl.
CPC ..... *B41F 17/22* (2013.01); *B41F 33/0009* (2013.01)

(58) Field of Classification Search
CPC ..... B41F 17/20; B41F 17/22; B41F 33/0009; B65G 2201/0252; B65G 2201/0235
See application file for complete search history.

(56) References Cited

U.S. PATENT DOCUMENTS 4,741,266 A 5/1988 Stirbis et al.
4,926,788 A 5/1990 Metcalf
(Continued)

FOREIGN PATENT DOCUMENTS

DE 102018201033 B3 10/2018
EP 1132207 A1 9/2001
(Continued)

OTHER PUBLICATIONS

International Search Report of PCT/EP2020/076912 dated Dec. 23, 2020.

*Primary Examiner* — Jennifer Bahls
*Assistant Examiner* — Quang X Nguyen
(74) *Attorney, Agent, or Firm* — Mattingly & Malur, PC

(57) ABSTRACT

A method is provided for operating a device that is usable for printing the respective lateral surface of hollow objects. The device comprises at least one mandrel wheel for holding the hollow objects on projecting expanding mandrels, and a transfer wheel for transporting the hollow objects, which transfer wheel is arranged downstream of the mandrel wheel in a transport direction of the hollow objects. The mandrel wheel and the transfer wheel are each rotatably arranged in a laterally offset manner, with respect to one another, in two different planes that are parallel to one another. Hollow objects, which are printed during ongoing printing production, are transferred from the work arbors of the mandrel wheel to the transfer wheel. During a modification of the device, from a first production of hollow objects having a first height, to a second production of hollow objects having a second height, a lateral offset between the mandrel wheel and the transfer wheel is adapted to the height of the hollow objects to be printed in the second production by automatically changing the axial position of the transfer wheel relative to the position of the mandrel wheel.

19 Claims, 2 Drawing Sheets

(56) References Cited

U.S. PATENT DOCUMENTS

| | | | | |
|---|---|---|---|---|
| 6,167,805 | B1 | 1/2001 | Williams et al. | |
| 2001/0025572 | A1* | 10/2001 | Aichele | B41F 17/22<br>101/35 |
| 2017/0197401 | A1* | 7/2017 | Endou | B41F 17/18 |

FOREIGN PATENT DOCUMENTS

| | | | |
|---|---|---|---|
| WO | 2012/148576 | A1 | 11/2012 |
| WO | 2018013465 | A1 | 1/2018 |

* cited by examiner

METHOD AND DEVICE FOR PRINTING THE RESPECTIVE LATERAL SURFACE OF HOLLOW OBJECTS

CROSS-REFERENCE TO RELATED APPLICATIONS

This application is the US national phase, under 35 USC § 371, of PCT/EP 2020/076912, filed Sep. 25, 2020; published as WO 2021/089236 A1 on May 14, 2021, and claiming priority to DE 10 2019 129 926.8, filed Nov. 6, 2019, the disclosures of which are expressly incorporated herein in their entireties by reference.

FIELD OF THE INVENTION

The present invention relates to a method and to a device for printing the respective lateral surface of hollow objects. A method for printing the respective lateral surfaces of hollow objects utilizes a device for printing those respective lateral surfaces of such hollow objects. The device comprises at least one mandrel wheel holding the hollow objects on projecting expanding mandrels, and a transfer wheel for transporting the hollow objects, which transfer wheel is arranged downstream from the mandrel wheel in a transport direction of the hollow objects. The mandrel wheel and the transfer wheel are each rotatably arranged in an offset manner, in the axial direction, with respect to one another in two different planes that are parallel to one another. Hollow objects that are printed during ongoing production are transferred from the expanding mandrels on the mandrel wheel to the transfer wheel.

BACKGROUND OF THE INVENTION

As is known from WO 2012/148576 A1, for example, multiple printing units are typically used in the packaging industry in a device for decorating hollow objects that each have a cylindrical lateral surface. Each of these printing units transfers a respective printing ink onto a printing blanket used jointly by these printing units. The lateral surface of the hollow object in question is then decorated with an, e.g., multi-color print motif by a relative movement between the lateral surface of the hollow object in question and the previously inked multi-color printing blanket, in particular in multiple colors, in particular by way of a rolling motion of the lateral surface of the hollow object in question on this printing blanket.

Such a device for printing or for decorating hollow objects that in each case, in particular, have a cylindrical lateral surface is used, e.g., in conjunction with a production system that generally comprises multiple work stations to manufacture and further process such hollow objects, wherein the printing or the decorating of the hollow objects takes place by way of a printing method that is carried out, or at least can be carried out, industrially, which is why these hollow objects can, generally speaking, also be referred to as printed products. In such a production system, the hollow objects to be printed are manufactured in a large-scale production operation in volumes of, e.g., several hundred or even several thousand pieces per minute, e.g., between 1,500 and 2,500 pieces per minute, particularly preferably between 1,800 and 2,200 pieces per minute. Such hollow objects are, e.g., made of metal, in particular steel or aluminum, or of a plastic material. Such hollow objects made of metal are used, e.g., as beverage cans or as aerosol cans. Such hollow objects made of plastic are produced, e.g., in the form of thermoplastic molded objects and are used, e.g., as cups for packaging, e.g., liquid or pasty foodstuffs, in particular dairy products or beverages. Another type of hollow objects to be printed in an aforementioned device can be preferably cylindrical containers or vessels made of glass, e.g., bottles or vials.

Beverage cans are preferably made of aluminum and are, in general, so-called two-part cans in which a circular bottom, together with a preferably straight cylinder shell, are in each case produced from a single workpiece, i.e., from a so-called slug or from a round blank, i.e., a circular disk, in a forming process, e.g., in a cold extrusion process or in a tensile-compression forming process, preferably by way of deep drawing, in particular by way of deep-drawing and ironing, to form a hollow object that is open on one side, e.g., to form a so-called can blank, and wherein, during a manufacturing step carried out at the end of production, a circular lid is placed onto the cylinder shell and joined in an air-tight manner to the cylinder shell by way of flanging.

An aerosol can, which can also be referred to as a pressurized can or spray can, is a metal can for spraying liquids. In an aerosol can, the added liquid is pressurized, wherein, e.g., propane, butane, dimethyl ether or mixtures thereof, or also compressed air or nitrogen, are used as propellants for discharging the liquid in question from the can in question.

Commercially available beverage cans are configured for a fill volume of, e.g., 330 ml or 500 ml. Beverage cans that have a fill volume of 330 ml or 500 ml in each case usually have a diameter of approximately 67 mm. The height of the 330-ml variant is generally 115 mm, and that of the 500-ml variant is generally 168 mm. From this follows that the printable lateral surface of these hollow objects has a dimension of approximately 210 mm×115 mm, or approximately 210 mm×168 mm, respectively. This makes it indispensable to adapt the printing devices in the production system. To be even more flexible and to be able to print hollow objects having other formats, e.g., having a different diameter in the range of 50 mm to 100 mm and/or, in particular, having a different height in the range of 100 mm to 200 mm, in the same production system, extensive modification measures have thus far been necessary on the production system in question. When, e.g., two people carry out such a modification of the production system to accommodate a different height of the hollow objects to be printed, each of them requires, e.g., eight or more hours. Since such a long idle time of the production system is generally not tolerable, such production systems are thus far frequently only operated for a single, fixed format of hollow objects; however, this is extremely inflexible and no longer compatible with today's market needs.

The aforementioned WO 2012/148576 A1 describes a device for decorating cans, wherein a system composed of multiple printing units, each having an inking unit, is provided for the multi-color decoration of a multiplicity of cans. Each of the inking units forming part of the printing units comprises a respective ink fountain for supplying printing ink, wherein in each ink fountain a respective ink fountain roller is provided for receiving printing ink from the ink fountain in question. A respective duct roller is provided in each inking unit, wherein each duct roller receives printing ink from the ink fountain roller in question, wherein multiple oscillating inking rollers and multiple ink transfer rollers, which each cooperate with at least one of the oscillating inking rollers, are provided in a roller train arranged downstream from the respective duct roller in the inking unit in question. A respective printing plate cylinder including at least one printing plate is present for each inking unit, wherein in each case only a single ink application roller cooperates with the respective printing plate cylinder to apply the printing ink.

A device for decorating cans is known from U.S. Pat. No. 4,741,266 A, comprising multiple inking stations and plate cylinder devices, wherein each of the plate cylinder devices is driven separately by a main gear unit, wherein the main gear unit is assigned to a print roller device so as to be completely independent from the roller drive device of each inking station.

A continuous motion device for decorating cylindrical containers is known from U.S. Pat. No. 6,167,805 B1, wherein the device comprises: a decorating section and a conveying section, which conveys containers through a decorating zone in which decorations are applied to the containers, wherein the conveying section comprises: a carrier rotating steadily on a carrier axis, wherein the carrier comprises: a forward-facing side, multiple mandrel subassemblies, which are attached to the carrier at identical angular distances between adjoining subassemblies, wherein each of the subassemblies is attached so as to move back and forth along a single path, which is radially arranged with respect to the carrier axis as a center, wherein each of the subassemblies comprises: an extended support arm, which extends along a single one of the paths, an axis which extends forward from the arm and, in general, is parallel to the carrier axis, and a rail, which is attached to the arm and extends longitudinally therefrom, the axis comprising a spindle section for mounting a rotatable mandrel which conveys containers through the decorating zone, wherein the axis also includes a fastening section behind the spindle section, wherein the fastening section is connected to the arm at a radially outer end of the arm; for each of the subassemblies at least one slide unit being attached on the side of the carrier which faces forward and being operatively connected to the rail to slidingly mount the subassembly when it moves back and forth radially; and each of the rails including at least one bearing surface, which in each case is engaged with another group of bearing elements of the at least one slide unit.

A mandrel system for a can coating or decorating machine or the like is known from U.S. Pat. No. 4,926,788 A, comprising a ceramic sleeve element for supporting a workpiece and a sleeve support core element for supporting the ceramic sleeve element, and at least two axially spaced bearing units, which are supported by the sleeve support core element and/or the support core element.

A decorator comprising a mandrel wheel, a segmented wheel, a transfer wheel, and a transport chain is known from WO 2018/013465 A1, wherein the mandrel wheel, the segmented wheel, the transfer wheel, and the transport chain each comprise a motor and a decoder, wherein a controller is provided, wherein the controller adjusts or sets the respective speed of the mandrel wheel, the segmented wheel, the transfer wheel and the transport chain based on information received from the decoders.

A device for printing hollow objects is known from DE 10 2018 201 033 B3, comprising a segmented wheel and a unit for sequentially feeding the hollow objects to the periphery of the segmented wheel, wherein this unit comprises at least one conveyor wheel and a mandrel wheel, wherein first the conveyor wheel, then the mandrel wheel, and thereafter the segmented wheel are arranged in the transport direction of the hollow objects, wherein multiple drivers are arranged around the circumference of the conveyor wheel and multiple holding devices are arranged around the circumference of the mandrel wheel, each for receiving a respective hollow object to be printed in cooperation with the segmented wheel, wherein the mandrel wheel and the conveyor wheel each comprise a dedicated drive that is separate from the drive of the segmented wheel, wherein the drive of the segmented wheel and the drive of the mandrel wheel and the drive of the conveyor wheel are connected to one another by a shared data bus.

SUMMARY OF THE INVENTION

It is the object of the present invention to devise a method and a device for printing the respective lateral surface of hollow objects, by way of which a production changeover that is accompanied by a change in format, and in particular by a change in the height of the hollow objects to be printed, can be carried out within a short modification time.

The object is achieved according to the present invention by the provision that, during a modification of the device from a first production of hollow objects having a first height, to a second production of hollow objects having a second height, the offset in the axial direction between the mandrel wheel and the transfer wheel is adapted to the height of the hollow objects to be printed in the second production by automatically changing the axial position of the transfer wheel relative to the position of the mandrel wheel. A first drive is provided, by the use of which first drive, the axial position of the transfer wheel, relative to the position of the mandrel wheel, can be changed automatically. The offset in the axial direction between the mandrel wheel and the transfer wheel is adaptable to the height of the hollow objects to be printed in the second production process.

The advantages to be achieved with the present invention are, in particular, that a production changeover that is accompanied by a change in format, and in particular by a change in the height of the hollow objects to be printed, can be carried out much more quickly on a production system of the type in question, since no mounting work has to be carried out in the decorator for modifying the production system to a production operation of hollow objects that have a different height than the prior production operation.

BRIEF DESCRIPTION OF THE DRAWINGS

An exemplary embodiment of the invention is illustrated in the drawings and will be described in greater detail below. The advantages to be achieved with the invention are mentioned in conjunction with the exemplary embodiment.

The drawings show.

DESCRIPTION OF THE PREFERRED EMBODIMENTS

Figure 1:
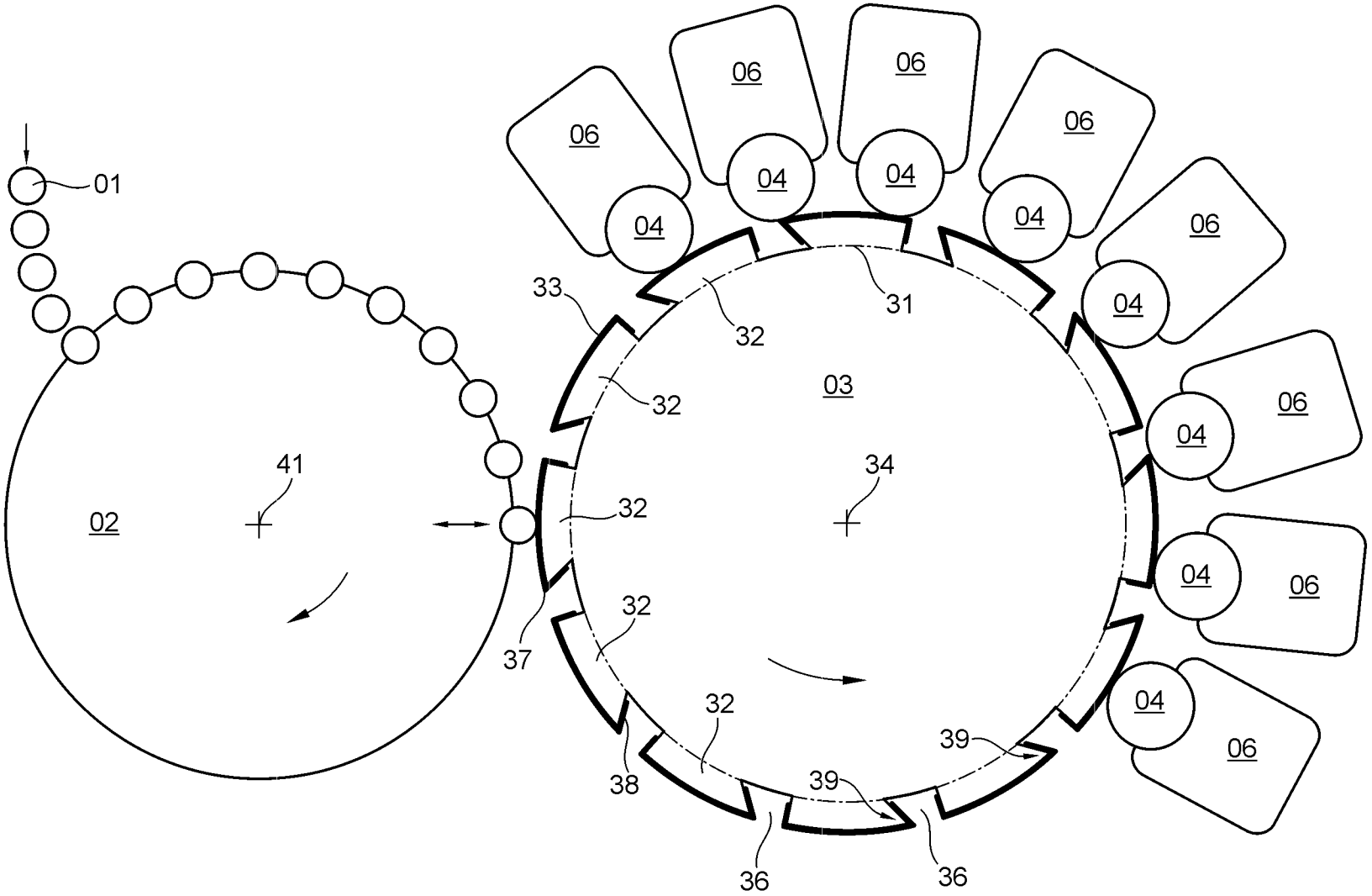
FIG. 1 a device for printing or decorating the respective lateral surface of hollow objects.

In a preferred embodiment an, e.g., multi-color print motif, i.e., at least one print motif, is applied to the lateral surface of a hollow object in a letterpress process. Alternative or additional printing methods are, e.g., a screen printing method or an offset printing method or a plateless digital printing method. The invention will be described hereafter by way of example in conjunction with an indirect letterpress printing method, in which printing ink is first applied to a printing blanket and is then transferred from there onto the lateral surface of a hollow object. To carry out this special letterpress printing method, a cliché-type printing plate serving as a printing forme is arranged on a lateral surface of a plate cylinder, which is why this cylinder is also referred to as a cliché cylinder at times, in particular when the cliché-type printing plate is arranged, e.g., on a sleeve mounted on the cylinder. The more general term "printing forme cylinder" used hereafter shall generally be understood to encompass both embodiments, i.e., the traditional embodiment as a plate cylinder and the embodiment as a "cliché cylinder." The printing plate ready-to-use for the printing process is a printing forme including a print relief, wherein this print relief, without mirroring, reflects the print image intended for the printing process of the indirect letterpress printing method, in contrast to the traditional, i.e., direct, letterpress printing method, wherein during trouble-free printing only the print relief plays a role in transferring the printing ink supplied to the plate cylinder by the inking unit onto at least one printing blanket cooperating with this plate cylinder.

The printing forme or the printing plate to be mounted onto a plate cylinder comprises, e.g., a plate-shaped, preferably flexible, carrier having a finite length, e.g., made of a steel sheet, wherein an, in particular flexible, printing element is arranged on this carrier. At least the opposing ends of the carrier, in the circumferential direction of the plate cylinder, can be pre-bent or angled, e.g., corresponding to the curvature of the lateral surface of the plate cylinder so as to enable easier mounting of the printing forme, i.e., here, in particular of the cliché-type printing plate, on the plate cylinder. The carrier of the printing forme or of the printing plate has a thickness in the range of, e.g., 0.2 mm to 0.3 mm. The printing plate, including its carrier, has an overall thickness in the range of, e.g., 0.7 mm to 1.0 mm, preferably approximately 0.8 mm. The printing element is made of a plastic material, for example. The printing element is exposed, e.g., with a negative film reflecting the print image for producing the printing plate ready for use for the printing process, wherein non-exposed areas are subsequently removed from the printing element, e.g., by washing them out or by means of a laser.

A device for printing or for decorating hollow objects, each having a preferably cylindrical lateral surface, is also referred to as a decorator and preferably comprises multiple, e.g., eight or ten or even more, printing units, which are also referred to as printing stations, wherein at least one of these printing units, and in the preferred embodiment all of these printing units, in each case comprise an inking unit and a rotatable printing forme cylinder, in particular a printing forme cylinder configured as a plate cylinder. The printing units or printing stations, optionally together with the printing forme cylinders in this device, are in each case mounted in a stand and can be used in the same printing process, so as to create a multi-color print motif, corresponding to the number of involved printing units or printing forme cylinders, on the same hollow object. The printing forme cylinders or plate cylinders are each preferably mounted at both ends; however, the mount can also be configured as a cantilevered mount, in which the printing forme cylinder or plate cylinder in question is only mounted at one of its end faces, e.g., in each case on a preferably conical pin. In general, only a single printing plate is arranged at the lateral surface of each printing forme cylinder, wherein the carrier of the printing plate envelops the circumference of the printing forme cylinder in question completely, or at least predominantly, in particular more than 80%. A length of the printing element of the printing plate which is oriented in the circumferential direction of the printing forme cylinder in question is preferably configured to be shorter than the circumferential length of the printing forme cylinder in question. The printing forme or the printing plate is arranged, or at least can be arranged, in particular magnetically, by means of its carrier, on the lateral surface of each printing forme cylinder, i.e., the printing forme or the printing plate is preferably held there magnetically, i.e., by means of a magnetic retaining force. In an alternative or additional variant embodiment of the device for printing or for decorating hollow objects that each have a preferably cylindrical lateral surface, at least one of the printing units is, or also several of these printing units are, in each case configured as a printing unit that prints in a plateless manner in a digital printing method, wherein such a printing unit in particular comprises at least one ink jet print head or a laser.

The, in particular simultaneous, transfer of multiple printing inks, in particular to the lateral surface of the hollow object in question, makes it necessary for this transfer of ink to be carried out with register accuracy so as to achieve good print quality during the printing process. For arranging the printing forme or the printing plate with register accuracy on the lateral surface of the printing forme cylinder or plate cylinder in question, in the preferred embodiment preferably multiple register pins are provided on the lateral surface of the printing forme cylinder or plate cylinder in question, the positions of which are, e.g., in each case settable and which engage in corresponding recesses formed on the printing forme or the printing plate, and thereby ensure a defined position of the printing forme or the printing plate when the forme or plate is arranged on the lateral surface of the printing forme cylinder or plate cylinder in question. In particular, a lateral register of the printing forme or of the printing plate on a, for example cut, side edge of this printing forme or of this printing plate, and a circumferential register of this printing forme or of this printing plate can be aligned at a stop. In a preferred embodiment, each printing forme cylinder or plate cylinder has a respective diameter in the range between 100 mm and 150 mm, in particular between 120 mm and 130 mm, wherein an axial length of the printing forme cylinder or plate cylinder in question in each case is, e.g., between 200 mm and 250 mm, in particular between 200 mm and 220 mm. The printing plate to be arranged on the lateral surface of the printing forme cylinder or plate cylinder in question has a width, oriented in the axial direction of the plate cylinder in question, in the range of, e.g., 100 mm to 200 mm.

With its printing forme or with its printing plate, each of the printing forme cylinders used in the printing process and configured, e.g., as a plate cylinder, transfers a certain printing ink onto a printing blanket. The printing inks used are generally premixed, in particular application-specific, special inks, which are specially matched, e.g., with respect to their respective printability, to the material of the hollow object to be printed, depending on whether a surface, e.g., made of aluminum, tinplate or a plastic material, is printed. In addition, these application-specific special inks usually also differ in their color shade. In a preferred embodiment of a device for printing or for decorating hollow objects that each, e.g., have a cylindrical lateral surface, a unit is provided that transfers printing ink from the printing forme or the printing plate onto the lateral surface of the hollow object in question. This unit transferring printing ink is preferably configured as a segment rotating about an in particular horizontal axis, wherein preferably multiple, e.g., eight, ten, twelve or even more, printing blankets are arranged, or at least can be arranged, consecutively on the periphery of this segmented wheel, i.e., along its circumference. The unit transferring printing ink can be configured as an alternative to the segmented wheel, depending on which printing method used, but also as a decorating drum or as a printing blanket cylinder or as a transfer cylinder, which can each be rotated about an axis of rotation, at least during printing. The printing blankets are arranged around the circumference of the segmented wheel, e.g., in that the printing blankets are in each case attached to the circumference of the segmented wheel, e.g., by integral joining, preferably by adhesive bonding. Each of the preferably multiple printing forme cylinders or plate cylinders is set, or at least can be set, radially against the printing blankets arranged around the circumference of the segmented wheel in question. In a particularly preferred embodiment of a device for printing or for decorating hollow objects that each, e.g., have a cylindrical lateral surface, i.e., a decorator, the number of printing blankets that are arranged consecutively along the circumference of the segmented wheel is greater than the number of printing forme cylinders or plate cylinders that are in each case set, or at least can be set, radially against the segmented wheel.

The preferably carousel-like unit transferring printing ink, in particular the segmented wheel, has a diameter of, e.g., 1,400 mm to 1,600 mm, preferably approximately 1,520 mm to 1,525 mm and, e.g., in the case of eight assigned printing forme cylinders or plate cylinders, comprises, e.g., twelve printing blankets consecutively around its circumference. The surface of each printing plate is preferably configured to have a greater hardness than the hardness of the respective surface of the printing blankets.

The surface of the printing blankets is preferably configured to be planar, i.e., without profiling. In an operating state in which each of the printing forme cylinders or plate cylinders involved in the printing process is set radially against the printing blankets of the rotationally driven segmented wheel, the respective printing formes of these printing forme cylinders or the respective printing plates of these plate cylinders carry out a rolling motion on the printing blankets moved by way of the segmented wheel, wherein each printing plate presses at least its print relief into, or at least onto, the respective printing blanket. An intensity of the pressing is settable, or is set, e.g., prior to or at the beginning of a printing process, e.g., by means of remote actuation, by setting a contact pressure that is exerted by the relevant printing forme cylinder or plate cylinder onto the relevant printing blanket of the segmented wheel.

The hollow objects to be printed here by way of example, e.g., the two-part cans to be printed, are, e.g., brought close to at least one of the printing units belonging to the device for printing a lateral surface of hollow objects, continuously or at a set cycle, by means of a transport device transporting the hollow objects to be printed about an axis of rotation, preferably along at least a portion of a circular path, i.e., a circular arc, preferably by means of at least one feed wheel, in particular by means of a mandrel wheel, and are thereby transported into a printing zone of at least one of these printing units. In particular, the hollow objects to be printed are brought close to at least one of the printing blankets, which are arranged, e.g., on the segmented wheel, by means of the transport device, or the hollow objects to be printed are each transported directly and indirectly, i.e., without the aid of a unit that transfers printing ink and is configured, e.g., as a segmented wheel, into the respective printing zone of at least one of these printing units by means of this transport device, which is the case, e.g., when the relevant printing unit prints in a direct printing process, e.g., an ink jet printing process.

The feed wheel or mandrel wheel likewise rotating about a preferably horizontal axis, e.g., similarly to the segmented wheel, concentrically to its circumferential line, at a preferably equidistant distribution, comprises multiple, e.g., 24 or 36, holding devices, holders for short, e.g., each in the form of an expanding mandrel projecting from an end face of the mandrel wheel, or a spindle, wherein each holder holds, or at least can hold, one of the respective hollow objects to be printed. A transport device configured as a mandrel wheel is also at times referred to as a rotary table including spindles. A mandrel wheel is described, e.g., in EP 1 165 318 A1. A description of suitable holders, spindles, or expanding mandrels can be found, e.g., in WO 2011/156052 A1. Hereafter, an expanding mandrel is referred to as a mandrel, for short. A longitudinal axis of each mandrel is oriented parallel to the axis of the mandrel wheel. In the case of hollow objects to be printed that each are, e.g., configured as a two-part can, each of these hollow objects is brought close to the transport device, configured, e.g., as a mandrel wheel, by means of a conveyor device, e.g., a belt conveyor and/or a conveyor wheel, where it is placed over one of the mandrels of the mandrel wheel, at a transfer station, by suction, e.g., by means of negative pressure, and is then held by the mandrel in question, while the transport device configured as a mandrel wheel transports the respective hollow object to be printed, e.g., to the segmented wheel bearing at least one printing blanket, and thus in the direction of at least one of the printing units or, in an alternative embodiment, transports it directly, e.g., without a segmented wheel, to at least one of the printing units. In general, a larger number of hollow objects to be printed is fed in rapid succession to the mandrel wheel by way of the conveyor device. A conveyor device is described, e.g., in EP 1 132 207 A1.

A gap having a width of less than 1 mm, e.g., of 0.2 mm, is preferably formed between an inner wall of the respective hollow object to be printed and the surface of the relevant mandrel of the mandrel wheel, so that the hollow object to be printed is not held by pressing on the relevant mandrel. Each mandrel can be rotated about its respective longitudinal axis substantially without friction. Each of the mandrels is set, or at least can be set, to a certain circumferential speed by a drive mechanism cooperating with the respective mandrel, e.g., by means of friction, in such a way that each hollow object to be printed and held by a mandrel, in addition to the rotation of the mandrel wheel, is arranged so as to rotate, or at least can be rotated, by a rotation that is carried out, or at least can be carried out, independently by the mandrel. The hollow object to be printed is preferably placed on one of the mandrels of the mandrel wheel during an idle phase of the mandrel in question, wherein the mandrel in question, during its idle phase, does not carry out a rotational movement about its own longitudinal axis. It is preferably checked, e.g., in a contactless manner, by way of a sensor that each mandrel bears a hollow object to be printed. If a mandrel does not bear a hollow object to be printed, the mandrel wheel is moved in such a way, e.g., that contact between the relevant free mandrel, and optionally several other mandrels, with a printing blanket of the segmented wheel is reliably avoided.

Prior to being fed, e.g., to the mandrel wheel, two-part cans to be printed are produced in a processing station arranged upstream from the mandrel wheel, e.g., deep-drawn from a blank. In another processing station, the rim of each two-part can is trimmed at its open end face. Each two-part can is, e.g., washed in further processing stations, in particular their inside is washed, and the inner wall and the bottom of the relevant two-part can are optionally also coated. At least the outer lateral surface of each two-part can is, e.g., primed, in particular with a white primer. After its lateral surface has been printed, each two-part can is removed from its respective holder, e.g., at the mandrel wheel, e.g., by way of compressed air or by way of a preferably switchable magnet, and is fed to at least one processing station arranged downstream from the mandrel wheel, e.g., to a coating station for coating the outer lateral surface of each printed two-part can and/or to a rim processing station. The printed two-part cans in particular pass through a dryer, e.g., a hot air dryer so as to cure the at least one printing ink applied to their respective lateral surface.

The printing process for printing in particular the respective lateral surface of, e.g., hollow objects, in particular two-part cans, that are held at the mandrel wheel, begins by applying all the printing inks that are needed for the print image to be printed onto the respective lateral surface of the hollow object, e.g., from the respective printing plate of the plate cylinders set, e.g., against the segmented wheel by one of the printing blankets arranged around the circumference of the segmented wheel. The printing inks needed for the print image to be printed onto the respective lateral surface of the hollow object are thus collected on the respective printing plate. The relevant printing blanket inked with all the necessary printing inks then, in direct contact between the printing blanket and the lateral surface of the hollow object to be printed, simultaneously transfers these printing inks onto the lateral surface of this hollow object during a single revolution of the hollow object to be printed, which is held on one of the mandrels of the mandrel wheel, about its longitudinal axis. While the printing inks are transferred from the printing blanket onto the lateral surface of the hollow object, the hollow object to be printed, which is held, e.g., by one of the mandrels of the mandrel wheel, rotates at a circumferential speed that is identical, in absolute terms, to that of the relevant printing blanket, which, e.g., is arranged around the circumference of the segmented wheel. The respective circumferential speeds of the hollow object and of the printing blanket or of the segmented wheel are consequently synchronized, wherein the hollow object to be printed, which, e.g., is held on one of the mandrels of the mandrel wheel, is accordingly accelerated, e.g., from its idle state in particular until the circumferential speed of, e.g., the segmented wheel has been reached, in particular by a drive means acting on the relevant mandrel, wherein the circumferential speed of the relevant mandrel of the mandrel wheel, preferably starting at a first contact point of the hollow object to be printed with the relevant printing blanket as its lateral surface carries out a rolling motion over a stretch of, e.g., the first 50 mm of the circumferential length of the printing blanket, is synchronized with the circumferential speed of the segmented wheel. In the preferred embodiment, the segmented wheel supporting the relevant printing blanket specifies the circumferential speed to be set, e.g., at the respective mandrel of the mandrel wheel. The circumferential speed of the printing forme cylinder supporting the printing form or of the plate cylinder supporting the printing plate is also preferably set as a function of the circumferential speed of, e.g., the segmented wheel. In the preferred embodiment, at least the mandrel wheel and the segmented wheel are each rotationally driven individually by a dedicated drive and controlled by open-loop or closed-loop control by a control unit in terms of their respective rotational behavior.

With reference to the previously described device for printing or for decorating in particular hollow objects that each have an, e.g., cylindrical lateral surface, various details will be described hereafter by way of example. In a schematic representation, FIG. 1, in a simplified manner and by way of example, shows a device for printing or for decorating in particular hollow objects 01 that each have a preferably cylindrical lateral surface, e.g., two-part cans 01, wherein these hollow objects 01 are sequentially fed by way of a conveyor device to the transport device configured, e.g., as a rotating, or at least rotatable, feed wheel, in particular as a mandrel wheel 02, where they are held individually at this transport device on a holder configured in each case as an expanding mandrel or as a spindle. Due to the selected exemplary embodiment for the printing press or the device for printing hollow objects, it is assumed hereafter that this transport device is preferably configured as a mandrel wheel 02 which rotates, or at least is rotatable, about an axis of rotation 41. A unit transferring a printing ink, e.g., a segmented wheel 03 which rotates, or at least is rotatable, about an axis of rotation 34, preferably cooperates with the mandrel wheel 02, with multiple printing blankets 33 being arranged along the circumference of this unit or segmented wheel. In assignment to the segmented wheel 03 mentioned by way of example, multiple printing forme cylinders 04, in particular plate cylinders 04, that are set, or at least can be set, radially against this segmented wheel 03 are provided along its circumferential line, wherein in each case a printing forme, in particular a cliché-type printing plate, is arranged on the respective lateral surface of these printing forme cylinders 04 or plate cylinders 04, wherein this cliché-type printing plate is in particular configured to carry out a letterpress printing method. A certain printing ink is fed to each of the printing forme cylinders 04 or plate cylinders 04 for inking its printing forme or its cliché-type printing plate by means of an inking unit 06. Hereafter, it is assumed by way of example that the printing forme cylinders 04 are in each case configured as a plate cylinder 04 supporting at least one printing plate.

Figure 2:
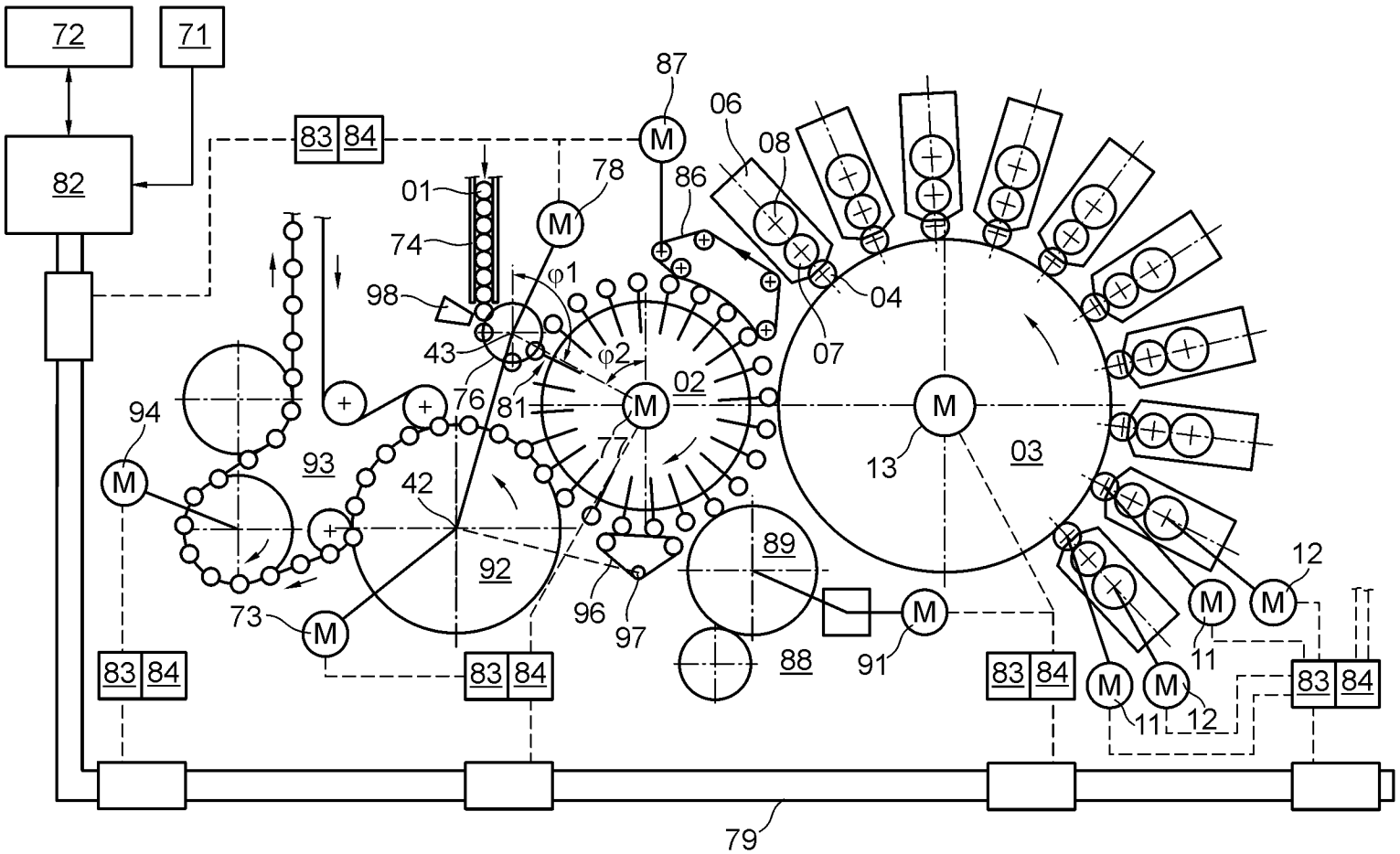
FIG. 2 the device according to FIG. 1 including its drive controller.

Multiple, e.g., eight, ten or twelve, printing units that each print different printing inks are consecutively arranged along the circumference of the segmented wheel 03 in its direction of rotation, each comprising a plate cylinder 04 and an inking unit 06, wherein each printing unit 06 is preferably configured as an anilox inking unit and, e.g., comprises only a single ink application roller 07 and an anilox roller 08 (FIG. 2). Multiple, e.g., 12, printing blankets 33 are consecutively arranged, preferably equidistantly, around the circumference of the segmented wheel 03, wherein a mandrel wheel 02 comprising 24 holding devices is set to rotate at half the rotational speed compared to a segmented wheel 03 including 12 segments 32. Each printing blanket 33 arranged in each case on one segment 32 around the circumference of the segmented wheel 03 is configured, e.g., as a metal printing blanket and is preferably held by a magnetic force at the relevant segment 32 of the segmented wheel 03. The segmented wheel 03 preferably comprises a main body, wherein the multiple, e.g., twelve, segments 32 are arranged, or at least can be arranged, along the circumference of the main body, e.g., in each case at a joint 31, in particular spaced apart from one another. In the preferred embodiment, the segmented wheel 03 is thus not configured in one piece, having segments 32 already integrally formed thereon, but each of the segments 32 forms a dedicated machine element that can be separated from the main body and is interchangeably arranged at the main body, e.g., by releasing at least one connecting element.

In the preferred embodiment, each printing blanket 33 to be arranged at the segmented wheel 03 is integrally applied, in particular by adhesive bonding, onto a preferably flat tabular metal carrier having a material thickness of, e.g., 0.2 mm. The respective preferably magnetizable metal carrier is then arranged, in particular in the correct position, together with the printing blanket 33 arranged thereon, on one of the segments 32 around the circumference of the segmented wheel 03, e.g., by at least one holding magnet provided there around the circumference for each printing blanket 33 or its carrier. To support the correctly positioned arrangement of the respective metal carrier on the relevant segment 32 around the circumference of the segmented wheel 03, a respective acute-angled mounting arm 38 is provided, e.g., at the leading edge 37 of the respective metal carrier which extends in the direction of rotation of the segmented wheel 03, wherein this mounting arm 38, when the respective metal carrier is arranged on one of the segments 32 around the circumference of the segmented wheel 03, engages in a recess 36 that is formed, e.g., as a groove, around the circumference of this segmented wheel 03 and oriented parallel to its axis of rotation 34, and comes to bear, in particular positively, against a leading edge 39 of the relevant recess 36 in the direction of rotation of the segmented wheel 03. The printing blankets 33 are in each case preferably embodied as rubber printing blankets. The direction of rotation of the segmented wheel 03 during the printing process is indicated by a directional arrow in FIG. 1. During the printing process, the hollow objects 01 brought close to the segmented wheel 03 in each case on an expanding mandrel by the mandrel wheel 02 rotating about the axis of rotation 41 are briefly pressed individually and consecutively by a predominantly radial movement of the relevant expanding mandrel, i.e., in general for a single revolution of the hollow object 01 to be printed, against the relevant printing blanket 33 that is presently printing, which is indicated in FIG. 1 by a double arrow indicating the movement of the relevant hollow object 01 to be printed.

FIG. 2, in a schematic and simplified illustration, shows an embodiment of the device for printing hollow objects 01 in which multiple hollow objects 01 are fed sequentially, by way of a conveyor device 74, in the transport direction T indicated by an arrow to a conveyor wheel 76, and from there to the mandrel wheel 02, and thereafter to the segmented wheel 03. The conveyor device 74 comprises at least two elements that are spaced apart from one another and that each guide the hollow objects 01, wherein these elements in each case guide, e.g., the head and the bottom of the relevant hollow objects 01. When the height of the relevant hollow objects 01 changes, it is necessary to adapt the distance between elements that each guide the head and the bottom of the relevant hollow objects 01 to the current height of the relevant hollow objects 01. It must be ensured that the hollow objects 01 to be fed to the printing process are arranged neither too loosely nor too tautly at the head and at the bottom between the elements of the conveyor device 74 which guide these hollow objects 01, since otherwise smooth and/or trouble-free transport of these hollow objects 01 is not guaranteed, especially at higher speeds.

The conveyor wheel 76 rotating, or at least rotatable, about an axis of rotation 43, and the mandrel wheel 02 rotating, or at least rotatable, about its axis of rotation 41 form a unit for sequentially feeding the hollow objects 01 to the circumference of the segmented wheel 03. Multiple, e.g., eight or ten, drivers are arranged around the circumference of the conveyor wheel 76, and multiple, e.g., 24 or 36, holding devices, each receiving hollow objects 01 to be printed in cooperation with the segmented wheel 03, are arranged around the circumference of the mandrel wheel 02. The drivers of the conveyor wheel 76 are formed, e.g., by recesses at its circumference, wherein each recess can always receive exactly one hollow object 01 at a particular point in time and convey it during the rotation of the conveyor wheel 76. A hollow object 01 being received in the relevant recess of the conveyor wheel 76 is supported, e.g., by a blower air device 98 arranged in the periphery of the conveyor wheel 76, wherein, as a function of an angular position of the conveyor wheel 76, the blower air device 98 in each case triggers at least one air blast in the direction of the conveyor wheel 76, which pushes the relevant hollow object 01. In an advantageous embodiment, the conveyor wheel 76 is configured as a star wheel including multiple drivers, each in the form of pointy teeth, wherein a hollow object 01 received in an intermediate space between adjoining teeth is conveyed during the rotation of the star wheel.

The mandrel wheel 02 and the conveyor wheel 76 each comprise a dedicated drive 77; 78 that is separate from the drive 13 of the segmented wheel 03 and, e.g., configured as a motor, wherein the drive 13 of the segmented wheel 03 and the drive 77 of the mandrel wheel 02 and the drive 78 of the conveyor wheel 76 have a data connection to one another via a shared data bus 79. This preferably digital data bus 79 connecting the drives 13; 77; 78 is configured, e.g., in a ring topology or in a star topology. A control unit 82, which is connected to the data bus 79 and configured, e.g., as a central machine controller, controls at least both the drive 78 of the conveyor wheel 76 and the drive 77 of the mandrel wheel 02, preferably also the drive 13 of the segmented wheel 03, and further, in particular all, drives connected to this data bus 79, by means of control data transported via the shared data bus 79. In a decorator comprising multiple dedicated drives connected via a shared data bus 79, the drive 77 of the mandrel wheel 02 or the drive 13 of the segmented wheel 03, e.g., is in each case established as a master, so that the remaining drives, each serving as slaves, align their respective rotational behavior with the previously established master. Due to the control data controlling the drive 78 of the conveyor wheel 76 and the drive 77 of the mandrel wheel 02, at least one pair of discrete angular positions φ1; φ2, which consists of a first angular position φ1 assumed, or to be assumed, by one of the drivers around the circumference of the conveyor wheel 76 and a second angular position φ2 assumed, or to be assumed, by one of the holding devices around the circumference of the mandrel wheel 02, in each case at a transfer position 81 at which the respective hollow body 01 is transferred from the conveyor wheel 76 to the mandrel wheel 02, is fixedly set in relation to one another, in each case with respect to this transfer position 81. This means that the angular positions φ1; φ2 forming the relevant pair of angular positions φ1; φ2 remain unchanged with respect to the transfer position 81 during a respective rotation of the conveyor wheel 76 and the mandrel wheel 02, and more particularly preferably for all drivers of the conveyor wheel 76 and all holding devices around the circumference of the mandrel wheel 02 which, at least during production of the device for printing hollow objects 01, are in each case to be positioned at the transfer position 81 at which the respective hollow body 01 is transferred from the conveyor wheel 76 to the mandrel wheel 02. The control data transported via the data bus 79 to the respective drive 13; 77; 78 preferably includes at least one angular position to be assumed by its shaft and/or the respective rotational speed of the shaft of the relevant drive 13; 77; 78. This control data thus carries out the function of a virtual master axis, e.g., with respect to the relevant decorator. The control data transported via the virtual master axis is a reference variable for the axes to be coordinated of the drives 13; 77; 78 connected to this data bus 79. A position target value is calculated from the control data forming a position value of the virtual master axis, i.e., the master value of the virtual master axis, for each slave axis given by the drives 13; 77; 78. At least the drive 77 of the mandrel wheel 02 and the drive 13 of the segmented wheel 03, and optionally also the drive 78 of the conveyor wheel 76, are each configured as an electric motor-operated direct drive that is closed loop position-controlled by the control unit 82 and/or set in terms of its respective rotational speed. The drive 13 of the segmented wheel 03 is configured, e.g., as a torque motor. In an advantageous embodiment, a dedicated drive controller 83 and a dedicated power unit 84, which are each connected to the data bus 79, are in each case assigned at least to the respective drives 13; 77; 78 of the conveyor wheel 76, the mandrel wheel 02 and the segmented wheel 03.

In addition to the rotation of the mandrel wheel 02, the hollow objects 01, which are in each case individually placed consecutively over one of the mandrels of the mandrel wheel 02 by suction, e.g., by means of negative pressure, and then held by the mandrel in question, are rotated by a rotation that is carried out, or at least can be carried out, independently by the mandrel, since each mandrel can be rotated about its respective longitudinal axis, and is thus set, or at least can be set, to a certain circumferential speed. In a preferred embodiment, at least one hollow object 01, preferably multiple hollow objects 01, each held at one of the mandrels of the mandrel wheel 02, are made to rotate, i.e., by way of friction, by a preferably continuously revolving acceleration belt 86 that is, e.g., arranged in particular in the periphery of the mandrel wheel 02 and preferably is in contact with these hollow objects 01, and are set to the circumferential speed required for the printing process, prior to being printed by means of at least one printing blanket 33 that is arranged around the circumference of the segmented wheel 03. This acceleration belt 86 preferably comprises a dedicated drive 87, which is separate from the drives 13; 77; 78 of the conveyor wheel 76, of the mandrel wheel 02 and/or of the segmented wheel 03, however, e.g., also connected to the data bus 79, wherein the circumferential speed of the acceleration belt 86 can be electively set. The circumferential speed of the acceleration belt 86 is thus individually settable and/or modifiable by its drive 87, e.g., for each hollow object 01, as a function of the requirements of the printing process. A dedicated drive controller 83 and a dedicated power unit 84 are also assigned, e.g., to the drive 87 of the acceleration belt 86.

At least one processing station arranged in the periphery of the mandrel wheel 02 after the hollow objects 01 have been printed is, e.g., configured as a coating unit 88 for coating the outer lateral surface of each printed hollow object 01 and/or, in particular in the case of two-part cans 01, as a rim processing station. The processing station configured as a coating unit 88 comprises at least one coating applicator roller 89 that is set, or at least can be set, against the lateral surface of at least one printed hollow object 01 held by the mandrel wheel 02. The coating-applying surface of the relevant coating applicator roller 89 is matched to the respective format of the hollow objects 01 to be coated. The reason is that, if the coating-applying surface of the relevant coating applicator roller 89 is too wide in the axial direction in relation to the current height of the hollow objects 01 to be coated, no coating material is picked up in at least one region of this surface of the coating applicator roller 89, and consequently increased coating splashes occur during the rotation of the coating applicator roller 89. If a coating-applying surface of the relevant coating applicator roller 89 is too small in the axial direction in relation to the current height of the hollow objects 01 to be coated, it is not possible to completely coat the lateral surface of the hollow objects 01 to be coated. Both are undesirable, which is why the size of the coating-applying surface of the relevant coating applicator roller 89, i.e., in particular the axial extension of this surface extending parallel to the axis of rotation of the relevant coating applicator roller 89, should always be matched to the respective format of the hollow objects 01 to be coated, and thus to their height. In addition, the axial extension of the coating-applying surface of this coating applicator roller 89 extending parallel to the axis of rotation of the relevant coating applicator roller 89 is to be axially positioned in congruent agreement with the height of these hollow objects 01, as a function of the current height of the hollow objects 01 to be coated.

The coating applicator roller 89 of the coating unit 88 is preferably rotationally driven by a dedicated drive 91, wherein, after having been printed by means of at least one printing blanket 33 arranged around the circumference of the segmented wheel 03, a hollow object 01 held at the mandrel wheel 02 is made to rotate by means of friction by the coating applicator roller 89 driven by the drive 91 and, e.g., is set to a certain circumferential speed, as a function of the requirements of the coating process. In particular, the circumferential speed of the hollow object 01 is set, or at least settable, by the drive 91 of the coating applicator roller 89 independently of the drives 13; 77; 78 of the conveyor wheel 76, the mandrel wheel 02 and/or the segmented wheel 03. Advantageously, a dedicated drive controller 83 and a dedicated power unit 84 are also assigned to the drive 91 of the coating applicator roller 89.

In an advantageous embodiment, a mechanical friction brake is arranged in the periphery of the mandrel wheel 02, e.g., at its lower rim, in the transport direction of the hollow objects 01, in particular downstream from the coating applicator roller 89 of the coating unit 88, wherein a friction body 96 of this friction brake is arranged to decelerate, by way of friction, at least one rotating hollow object 01 that is held at one of the holding devices of the mandrel wheel 02. The friction body 96 of the friction brake is moved relative to the rotating hollow object 01 held at one of the holding devices of the mandrel wheel 02, wherein the movement of the friction body 96 of the friction brake with respect to the lateral surface of the hollow object 01 has a tangential speed component. In a preferred embodiment, the friction body 96 of the friction brake is configured as a revolving deceleration belt 96 that is driven by a drive roller 97 and acts on at least one of the holding devices, wherein the deceleration belt 96 is arranged to decelerate, by way of friction, at least one rotating hollow object 01 that is held at one of the holding devices of the mandrel wheel 02, by its action on at least one of the holding devices of the mandrel wheel 02. The deceleration belt 96 is preferably arranged to revolve on deflection rollers and driven by the drive roller 97 in terms of its circulating movement. As a result of this deceleration process, at least one rotating hollow object 01 that is held at the mandrel wheel 02 and is decelerated by way of friction by the friction body 96 or by the deceleration belt 96, is set, after having been printed, to a circumferential speed necessary for further transport by at least one printing blanket 33 arranged around the circumference of the segmented wheel 03. This circumferential speed of the hollow object 01 is set, or at least settable, independently of the drives 13; 77; 78; 91 of the conveyor wheel 76 and/or of the mandrel wheel 02 and/or of the segmented wheel 03 and/or of the coating applicator roller 89 of the coating unit 88. The friction body 96 of the friction brake, which is, e.g., configured as a deceleration belt 96, enables an optimal deceleration process of the rotating hollow objects 01 that are about to the passed on. This deceleration process is advantageous or necessary in particular at thigh rotational speeds of the expanding mandrels in connection with expanding mandrels for large-volume hollow objects 01 with a high mass moment of inertia. Due to the deceleration process, the operational reliability during the transfer of the hollow objects 01 from the mandrel wheel 02 to a further transport device is considerably increased.

In the transport direction of the hollow objects 01, a conveyor device, which is configured, e.g., as a rotatable transfer wheel 92, is provided for their respective further transport and for receiving the hollow objects 01 that are held at the mandrel wheel 02, printed by means of at least one printing blanket 33 arranged around the circumference of the segmented wheel 03, and optionally coated at their lateral surface. A circumferential speed of the transfer wheel 92 is set, or at least settable, either by a dedicated rotary drive 73 or, e.g., as a function of the rotation of the conveyor wheel 76, e.g., by the drive 78 of this conveyor wheel 76, e.g., by means of a belt drive. In the latter case, the drive 73 of the transfer wheel 92 is coupled, e.g., mechanically or electrically, in particular in terms of control, e.g., to the drive 78 of the conveyor wheel 76. In the first alternative embodiment mentioned above, the shaft of the transfer wheel 92 is rotationally driven by a dedicated drive 73, i.e., a drive that is separate from the remaining drives 13; 77; 78; 87; 91, wherein this drive 73 is preferably configured as a motor. The transfer wheel 92 and the mandrel wheel 02 are arranged in a laterally offset manner, i.e., offset oriented in the axial direction, as a function of the height of the hollow objects 01 to be transferred, and are thus arranged to rotate in two different vertical planes that are parallel to one another. When the height of the printed and/or coated hollow objects 01 changes, e.g., due to a production changeover, this lateral offset of the transfer wheel 92 and the mandrel wheel 02 also has to be adjusted.

Downstream from the transfer wheel 92, in the transport direction of the hollow objects 01, a further conveyor device 93 for conveying printed and/or coated hollow objects 01, e.g., into a dryer, is preferably provided, wherein this conveyor device 93 is configured, e.g., as a revolving transport chain 93 including multiple, e.g., twenty or more, receiving elements, each for receiving one of the hollow objects 01 to be conveyed, and preferably comprises a dedicated drive 94, in particular a chain drive, wherein this drive 94 is preferably connected at least to the data bus 79 connecting the drives 13; 77; 78 of the segmented wheel 03, the mandrel wheel 02 and the conveyor wheel 76. A dedicated drive controller 83 and a dedicated power unit 84 are also assigned, e.g., to the drive 94 of this conveyor device 93. A lateral offset, which is to be adapted, e.g., during a production changeover, to the current height of the printed and/or coated hollow objects 01, also exists between this conveyor device 93 and the transfer wheel 92, as a function of the height of the hollow objects 01 to be transferred from the transfer wheel 92 to the conveyor device 93 configured, e.g., as a revolving transport chain 93.

According to the drive concept for a decorator described here by way of example, at least the drives 13; 77; 78 of the segmented wheel 03, the mandrel wheel 02 and the conveyor wheel 76 are in each case configured as dedicated drives and connected to one another via a shared data bus 79. Advantageously, further dedicated drives that are connected to the shared data bus 79 are provided in the device for printing hollow objects 01, e.g., the drive 87 for the acceleration belt 86 and/or the drive 91 for the coating applicator roller 89 of the coating unit 88 and/or the optionally dedicated drive 73 for the transfer wheel 92 and/or the drive 94 for the transport chain 93. All these drives 13; 73; 77; 78; 87; 91; 94 are controlled by a control unit 82, which is connected to the shared data bus 79 and configured, e.g., as a central machine control system, by means of control data transported via this shared data bus 79, wherein this control data preferably includes at least the respective rotational speed of the shaft of the relevant drive 13; 73; 77; 78; 87; 91; 94 and at least one angular position to be assumed by its shaft. The control unit 82 configured as a central machine control system is configured, e.g., as a control console belonging to the relevant decorator, wherein the control data required for the relevant drives 13; 73; 77; 78; 87; 91; 94 can be set at this control console.

In a preferred embodiment, the conveyor wheel 76, the mandrel wheel 02, the segmented wheel 03 and the transfer wheel 92 are synchronized by the control of their respective drives 13; 77; 78 by means of the control data transported via the shared data bus 79 in such a way that, at a certain point in time at which the conveyor wheel 76 transfers a hollow object 01 to the mandrel wheel 02, another hollow object 01 that is already arranged at the mandrel wheel 02 is in the process of being printed by a printing blanket 33 arranged at the segmented wheel 03, and still another, already printed hollow object 01 is being transferred from the mandrel wheel 02 to the transfer wheel 92.

One advantage of the drive concept using dedicated drives for a decorator instead of a central drive is the very high positioning accuracy that can in particular be achieved for the mandrel wheel 02 and the segmented wheel 03, whereby pin-point-precision printing on the lateral surface of the hollow objects 01 is made possible. The separate drive 87 for the acceleration belt 86 allows the rotation of each individual hollow object 01 arranged on a mandrel of the mandrel wheel 02 to be individual controlled, wherein, if necessary, a lead or a lag of the rotation of the relevant hollow object 01, in each case with respect to a printing blanket 33 arranged around the circumference of the segmented wheel 03, is set or at least can be set. The separate drive 94 for the transport chain 93 makes it possible to exactly count the conveyed hollow objects 01 and/or to deliberately channel out defective hollow objects 01. The separate drives 73; 77; 78; 94; for the units that are directly involved in the transport of the hollow objects 01, i.e., in particular the conveyor wheel 76, the mandrel wheel 02, the transfer wheel 92 and/or the transport chain 93, offer the advantage that the temporal use of the different transfer actions for transferring the relevant hollow objects 01 from one conveyor element to another can be set without mechanical intervention at the respective drive elements.

Advantageously, a motor 11 of the plate cylinder 04 and a motor 12 of the anilox roller 08 of the respective inking unit 06 cooperating with the segmented wheel 03 are also in each case assigned a dedicated drive controller 83 and a dedicated power unit 84. Using the above-described electronic control unit 82, the relevant motor 11 of the plate cylinder 04 and the relevant motor 12 of the anilox roller 08 is also controlled, or at least can be controlled, in each case, e.g., in terms of its angular position and/or in terms of its respective rotational speed. The respective drive controller 83 and the associated power unit 84 are preferably connected via the data bus 79 to the control unit 82 configured as a central machine control system, wherein this central control unit 82 is configured, e.g., as a control console belonging to the relevant decorator.

In the preferred embodiment, multiple, preferably all, drives or motors 11; 12; 13; 77; 78; 87; 91; 94 connected to the shared data bus 79 are in each case controlled, or at least controllable, individually and independently of one another. It is preferably provided that, for the respective control of the respective motors 11; 12; 13; 77; 78; 87; 91; 94, in each case at least one family of characteristics is stored in the central control unit 82 or, e.g., in the drive controller 83 belonging to the respective motor 11; 12; 13; 77; 78; 87; 91; 94. So as to facilitate, e.g., a production changeover, in particular a switch of the machine system to a production of hollow objects 01 having different formats, e.g., to cans having a shorter or longer can height and/or a different can diameter compared to the current production, it is advantageous for the respective motors 11; 12; 13; 77; 78; 87; 91; 94 to each be controlled, or at least be controllable, according to families of characteristics that are matched to one another. In this way, the respective motors 11; 12; 13; 77; 78; 87; 91; 94 that are in each case controlled, or at least controllable, individually and independently of one another, are synchronized with one another, as a function of the respective production previously set or selected in particular at the central control unit 82, i.e., in particular at the control console. On the other hand, it is also possible in the case of a drive concept using dedicated drives, e.g., for maintenance or repair or set-up or modification purposes, to individually, i.e., selectively, put into operation a first subset of the assemblies 02; 03; 04; 08; 76; 86; 89; 92; 93 drivable in each case by one of the motors 11; 12; 13; 77; 78; 87; 91; 94, in particular a single assembly 02; 03; 04; 08; 76; 86; 89; 92; 93 driven by one of the motors 11; 12; 13; 77; 78; 87; 91; 94, so that it carries out, or they carry out, a rotational movement, while at least one other assembly 02; 03; 04; 08; 76; 86; 89; 92; 93, i.e., a second subset of the assemblies 02; 03; 04; 08; 76; 86; 89; 92; 93 drivable by one of the motors 11; 12; 13; 77; 78; 87; 91; 94 in each case remains in idle.

In an advantageous embodiment, the movement of the friction body 96 of the friction brake which has the tangential speed component is mechanically coupled to the rotational movement of the transfer wheel 92. In the preferred embodiment, this means that the deceleration belt 96 is driven by the transfer wheel 92 in that the drive roller 97 of the deceleration belt 96 is mechanically coupled to a shaft 42 of the transfer wheel 92 which is rotationally driven by the drive 73. This coupling is indicated by a dotted line in FIG. 2. Mechanically coupling the movement of the friction body 96 of the friction brake to the rotational movement of the transfer wheel 92 is advantageous because, at this point of the transport path of the hollow objects 01, the tangential speed component in the movement of the friction body 96 of the friction brake does not necessarily have to be exactly adhered to in order to ensure trouble-free operation of the device for printing the respective lateral surface of hollow objects 01, and therefore a dynamic speed correction also does not necessarily have to be carried out. At this point of the transport path of the hollow objects 01, a more economical solution than the provision of a further dedicated drive for the friction body 96 of the friction brake can therefore be readily resorted to.

The transport path of the hollow objects 01 through the decorator, i.e., through the device for printing the respective lateral surface of hollow objects 01, thus begins at the conveying device 74 feeding unprinted hollow objects 01 in the transport direction indicated by the arrow in FIG. 2, and then consecutively progresses from the conveyor wheel 76, which is preferably configured as a star wheel, via the mandrel wheel 02 and the downstream transfer wheel 92, to the conveying device 93 discharging the printed and/or coated hollow objects 01, wherein this conveying device 93 is configured, e.g., as a revolving transport chain 93, as is indicated in FIG. 2 by the directional arrows, and preferably conveys the printed and/or coated hollow objects 01 in or through a dryer configured, e.g., as a hot air dryer, wherein this dryer generally forms a modular unit that is separate from the decorator, and thus is no longer an integral part of the decorator. As is apparent from FIG. 2, the hollow objects 01 are transported lying flat along this transport path, i.e., their respective height is essentially always oriented parallel to the respective axis of rotation 41; 42; 43 of the conveyor wheel 76, the mandrel wheel 02 and the transfer wheel 92, wherein the respective axes of rotation 41; 42; 43 of the conveyor wheel 76, of the mandrel wheel 02 and of the transfer wheel 92 in the decorator are arranged parallel to one another.

To shorten the makeready time on a device for printing the respective lateral surface of hollow objects 01 during the modification of this device from a first production of hollow objects 01 having a first height to a second production of hollow objects 01 having a second height different from the first height, a method is provided, in which the lateral offset between the mandrel wheel 02 and the transfer wheel 92 is adapted to the height of the hollow objects 01 to be printed in the second production by automatically changing the axial position of the transfer wheel 92 relative to the position of the mandrel wheel 02. Likewise, it can be provided that the device comprises a conveyor device 93 for transporting the hollow objects 01 which is arranged downstream from the transfer wheel 92 in the transport direction of the hollow objects 01 and configured as a revolving transport chain 93, wherein the transfer wheel 92 and the transport chain 93 are arranged in a laterally offset manner, i.e., offset oriented in the axial direction, with respect to one another in two different planes that are parallel to one another, wherein hollow objects 01 printed during ongoing production are transferred from the transfer wheel 92 to the transport chain 93, wherein the lateral offset between the transfer wheel 92 and the transport chain 93 is adapted to the height of the hollow objects 01 to be printed in the second production by automatically changing the axial position of the transfer wheel 92 relative to the position of the transport chain 93. The lateral offset between the mandrel wheel 02 and the transfer wheel 92 and the lateral offset between the transfer wheel 92 and the transport chain 93 are not always, but often configured to be identical in absolute terms.

In addition, during the modification of this device from a first production of hollow objects 01 having a first height to a second production of hollow objects 01 having a second height different from the first height, the distance between elements of the conveyor device 74 that each guide the head and the bottom of the relevant hollow objects 01 is preferably adapted to the height of the hollow objects 01 to be printed in the second production in that this adaptation is carried out by automatically setting this distance. In addition or as an alternative to adapting the distance between elements of the conveyor device 74, which each guide the head and the bottom of the relevant hollow objects 01, to the height of the hollow objects 01 to be printed in the second production, the respective axial extension, extending parallel to the axis of rotation of the relevant coating applicator roller 89, of the coating-applying surface of the at least one coating applicator roller 89 of the coating unit 88 is axially positioned in congruent agreement with the height of these hollow objects 01, as a function of the height of the hollow objects 01 to be coated in the second production, wherein this positioning of the coating-applying surface of the relevant coating applicator roller 89 is carried out automatically.

The change in the axial position of the transfer wheel 92 is preferably carried out by a motor-driven axial adjustment of this transfer wheel 92. The distance between elements of the conveyor device 74, which each guide the head and the bottom of the relevant hollow objects 01, is also preferably set by a motor-driven adjustment of these elements. Moreover, the positioning of the axial extension, extending parallel to the axis of rotation of the relevant coating applicator roller 89, of the coating-applying surface of this coating applicator roller 89 for the congruent agreement with the height of the hollow objects 01 to be coated in the second production is preferably carried out by a motor-driven axial adjustment of this coating applicator roller 89.

In a particularly advantageous embodiment of the identified solution, it is provided that settings that are based on the respective format of the hollow objects 01 are stored in each case in the control console belonging to the decorator, which is configured, e.g., as a control unit 82 configured as a central machine control system, and/or in a database 72 that, e.g., has a bidirectional data connection to the control unit 82, wherein these settings relate to a) a value for the lateral offset between the mandrel wheel 02 and the transfer wheel 92 and/or a value for the lateral offset between the transfer wheel 92 and the transport chain 93, and/or b) a value for the distance between elements of the conveyor device 74 which each guide the head and the bottom of the relevant hollow objects 01, and/or c) a value for the position, which is to be set for the congruent agreement with the height of the hollow objects 01 to be coated in the second production, of the axial extension of the coating-applying surface of this coating applicator roller 89 which extends parallel to the axis of rotation of the relevant coating applicator roller 89. One of the stored formats of the hollow objects 01 is selected at the control unit 82, or at least can be selected there, with respect to the intended production. It can also be provided that at least one recommended setting is displayed at the control unit 82 as a function of the selected format of the hollow objects 01. The control unit 82 then, in each case as a function in particular of the height of the hollow objects 01 to be printed and/or to be coated, sets a) the lateral offset between the mandrel wheel 02 and the transfer wheel 92 and/or the lateral offset between the transfer wheel 92 and the transport chain 93 in each case by controlling at least one of the drives assigned to the transfer wheel 92, and/or b) the distance between elements of the conveyor device 74, which each guide the head and the bottom of the relevant hollow objects 01, by controlling one of the drives assigned to the conveyor device 74, and/or c) the position of the axial extension, extending parallel to the axis of rotation of the relevant coating applicator roller 89, of the coating-applying surface of this coating applicator roller 89 for the congruent agreement with the height of the hollow objects 01 to be coated in the second production by controlling one of the drives assigned to the coating applicator roller 89. In the process, the control unit 82, for setting the necessary aforementioned settings, can activate the drive, or the respective drives, in each case as a function of the selected format of the hollow objects 01 automatically or based on an actuation of a control element 71 acting on the drive, or the respective drives, carried out by an operator. The actuation of multiple drives can be carried out simultaneously or staggered, i.e., consecutively. It is preferably provided that at least one precision adjustment of at least one of the required aforementioned settings is carried out, or at least possible, using a control element 71 that is provided at the control unit 82 or at the control console belonging to the decorator and acting on at least one of the respective drives. A precision adjustment here shall be understood to mean a setting of values, wherein these values can deviate in a range of up to −20% or +20% from the recommended format-dependent setting.

To carry out the aforementioned method, it is provided to configure the device for printing the respective lateral surface of hollow objects 01 with drives, wherein a first one of these drives, which is provided in addition to the rotary drive 73; 78 of the transfer wheel 92, adapts the lateral offset between the mandrel wheel 02 and the transfer wheel 92 by automatically changing the axial position of the transfer wheel 92 to the height of the hollow objects 01 to be printed in the second production relative to the position of the mandrel wheel 02, and/or wherein an additional second one of these drives, which is provided in addition to the rotary drive 73; 78 of the transfer wheel 92, adapts the lateral offset between the transfer wheel 92 and the transport chain 93 by automatically changing the axial position of the transfer wheel 92 to the height of the hollow objects 01 to be printed in the second production relative to the position of the transport chain 93, and/or wherein a third one of these drives adapts the distance between elements of the conveyor device 74, which each guide the head and the bottom of the relevant hollow objects 01, by automatically changing this distance, and/or wherein a fourth one of these drives, which is optionally provided in addition to the rotary drive 91 of the relevant coating applicator roller 89, brings the position of the axial extension, extending parallel to the axis of rotation of the relevant coating applicator roller 89, of the coating-applying surface of this coating applicator roller 89 into congruent agreement with the height of the hollow objects 01 to be coated in the second production. In the preferred embodiment, at least one of these drives, or all of these drives, are in each case configured as a linear motor. In the particularly preferred embodiment, the function of the second drive is assumed by the first drive, so that in fact only a single drive is needed for changing the axial position of the transfer wheel 92. All these drives are in each case controlled by the control unit 82 as a function of stored settings, which are in each case based on a format of the hollow objects 01 to be printed and/or to be coated, wherein these settings are stored in this control unit 82 and/or in the database 72 that has a data connection to the control unit 82. An adjustment path of the transfer wheel 92 for adapting the lateral offset between the mandrel wheel 02 and the transfer wheel 92 and/or for adapting the lateral offset between the transfer wheel 92 and the transport chain 93, in each case to the height of the hollow objects 01 to be printed in the second production, and/or an adjustment path for modifying the distance between elements of the conveyor device 74, which each guide the head and the bottom of the relevant hollow objects 01, and/or an adjustment path for changing the position of the axial extension, extending parallel to the axis of rotation of the relevant coating applicator roller 89, of the coating-applying surface of this coating applicator roller 89 are preferably each linear, wherein these adjustment paths in each case extend lengthwise along the height of the hollow objects 01 to be printed and/or to be coated. The respective adjustment paths in each case preferably extend in a range between 100 mm and 200 mm so as to be able to print hollow objects 01 having different heights in the same production system. The respective height, e.g., of all presently common two-part cans 01, in particular beverage cans, varies exactly in this range between 100 mm and 200 mm, so that a decorator, in which the respective adjustment paths of its transfer wheel 92 and/or conveyor device 74 and/or coating applicator roller 89 are in the described range, can be adapted very flexibly in a simple manner to different productions by the automatic adjustment. The hollow objects 01 conveyed by the conveyor device 74 or held by the expanding mandrels of the mandrel wheel 02 or transported by the transfer wheel 92 or by the transport chain 93 are each arranged lying flat along their transport path.

While a preferred embodiment of a method and a device for printing the respective lateral surfaces of hollow objects, in accordance with the present invention, has been set forth fully and completely hereinabove, it will be apparent to one of skill in the art that various changes could be made thereto, without departing from the true spirit and scope of the present invention, which is accordingly to be limited only by the appended claims.

The invention claimed is:

1. A method for operating a device for printing the respective lateral surface of hollow objects (01), the device comprising at least one mandrel wheel (02) holding hollow objects (01) on projecting expanding mandrels and a transfer wheel (92) for transporting the hollow objects (01), which is arranged downstream from the mandrel wheel (02) in the transport direction of the hollow objects (01), the mandrel wheel (02) and the transfer wheel (92) each being rotatably arranged in an offset manner in the axial direction with respect to one another in two different planes that are parallel to one another, hollow objects (01) printed during ongoing production being transferred from the expanding mandrels of the mandrel wheel (02) to the transfer wheel (92), characterized in that, during the modification of the device from a first production of hollow objects (01) having a first height to a second production of hollow objects (01) having a second height, the offset in the axial direction between the mandrel wheel (02) and the transfer wheel (92) is adapted to the height of the hollow objects (01) to be printed in the second production by automatically changing the axial position of the transfer wheel (92) relative to the position of the mandrel wheel (02).

2. The method according to claim 1, characterized in that the device comprises a conveyor device (93) for transporting the hollow objects (01), which is arranged downstream from the transfer wheel (92) in the transport direction of the hollow objects (01) and configured as a revolving transport chain (93), the transfer wheel (92) and the transport chain (93) being arranged in an offset manner in the axial direction with respect to one another in two different planes that are parallel to one another, hollow objects (01) printed during ongoing production being transferred from the rotating transfer wheel (92) to the revolving transport chain (93), and the offset in the axial direction between the transfer wheel (92) and the transport chain (93) being adapted to the height of the hollow objects (01) to be printed in the second production by automatically changing the axial position of the transfer wheel (92) relative to the position of the transport chain (93).

3. The method according to claim 1, characterized in that the device comprises a conveyor device (74) sequentially feeding a plurality of hollow objects (01) to be printed to the mandrel wheel (02), the conveyor device (74) comprising at least two elements that are spaced apart from one another and that each guide these hollow objects (01), these elements each guiding the head and the bottom of the relevant hollow objects (01), and the distance between elements of the conveyor device (74), which each guide the head and the bottom of the relevant hollow objects (01), being adapted to the height of the hollow objects (01) to be printed in the second production.

4. The method according to claim 3, characterized in that the distance between elements of the conveyor device (74), which each guide the head and the bottom of the relevant hollow objects (01), is adapted to the height of the hollow objects (01) to be printed in the second production by automatically setting this distance.

5. The device according to claim 4, characterized in that, the distance between elements of the conveyor device (74), which each guide the head and the bottom of the relevant hollow objects (01), is set by a motor-driven adjustment of these elements.

6. The method according to claim 1, characterized in that the device comprises a coating unit (88) for coating the outer lateral surface of the printed hollow objects (01), the coating unit (88) comprising at least one coating applicator roller (89), the relevant coating applicator roller (89) with a coating-applying surface being set, or at least being settable, against the lateral surface of at least one of the printed hollow objects (01) held by the mandrel wheel (02), an axial extension, extending parallel to the axis of rotation of the relevant coating applicator roller (89), of the coating-applying surface of this coating applicator roller (89) being positioned in congruent agreement with the height of these hollow objects (01) as a function of the height of the hollow objects (01) to be coated in the second production, the positioning of the axial extension, extending parallel to the axis of rotation of the relevant coating applicator roller (89), of the coating-applying surface of this coating applicator roller (89) for the congruent agreement with the height of the hollow objects (01) to be coated in the second production being carried out by a motor-driven axial adjustment of this coating applicator roller (89).

7. The method according to claim 1, characterized in that settings, which are based on a format of the hollow objects (01) to be printed and/or to be coated, are stored in each case in a control unit (82) belonging to the device and/or in a database (72) that has a data connection to this control unit (82), these settings relating to a) a value for the offset in the axial direction between the mandrel wheel (02) and the transfer wheel (92) and/or a value for the offset in the axial direction between the transfer wheel (92) and the transport chain (93) and/or b) a value for the distance between elements of the conveyor device (74), which each guide the head and the bottom of the relevant hollow objects (01), and/or c) a value for the position, to be set for the congruent agreement with the height of the hollow objects (01) to be coated in the second production, of the axial extension of the coating-applying surface of this coating applicator roller (89) which extends parallel to the axis of rotation of the relevant coating applicator roller (89).

8. The method according to claim 7, characterized in that the control unit (82), in each case as a function of the height of the hollow objects (01) to be printed and/or to be coated, sets a) the offset in the axial direction between the mandrel wheel (02) and the transfer wheel (92) and/or the offset in the axial direction between the transfer wheel (92) and the transport chain (93), in each case by controlling at least one of the drives assigned to the transfer wheel (92), and/or b) the distance between elements of the conveyor device (74), which each guide the head and the bottom of the relevant hollow objects (01), by controlling one of the drives assigned to the conveyor device (74), and/or c) the position of the axial extension, extending parallel to the axis of rotation of the relevant coating applicator roller (89), of the coating-applying surface of this coating applicator roller (89) for the congruent agreement with the height of the hollow objects (01) to be coated in the second production by controlling one of the drives assigned to the coating applicator roller (89).

9. The method according to claim 8, characterized in that at least one precision adjustment of at least one of the required aforementioned settings is carried out using a control element (71) that is provided at the control unit (82) and acts on at least one of the respective drives.

10. The device according to claim 8, characterized in that the control unit (82), for setting the necessary values, activates the drive, or the relevant drives, automatically or based on an actuation of a control element (71) acting on the drive, or the respective drives, carried out by an operator.

11. The device according to claim 7, characterized in that one of the stored formats of the hollow objects (01) is selected, or at least can be selected, at the control unit (82) with respect to the intended production.

12. The device according to claim 11, characterized in that at least one of the recommended settings is displayed at the control unit (82) as a function of the selected format of the hollow objects (01).

13. A device for printing the respective lateral surface of hollow objects (01), at least comprising a mandrel wheel (02) holding hollow objects (01) on projecting expanding mandrels and a transfer wheel (92), which is arranged downstream from the mandrel wheel (02) in the transport direction of the hollow objects (01), the mandrel wheel (02) and the transfer wheel (92) each being rotatably arranged in an offset manner in the axial direction with respect to one another in two different planes that are parallel to one another, hollow objects (01) printed during ongoing production being transferred from the expanding mandrels of the rotating mandrel wheel (02) to the revolving transfer wheel (92), characterized in that a first drive is provided, by which an axial position of the transfer wheel (92) relative to the position of the mandrel wheel (02) can be changed automatically, whereby the offset in the axial direction between the mandrel wheel (02) and the transfer wheel (92) is adaptable to the height of the hollow objects (01) to be printed in the second production.

14. The device according to claim 13, characterized in that a conveyor device (93) for transporting the hollow objects (01), which is arranged downstream from the transfer wheel (92) in the transport direction of the hollow objects (01) and configured as a revolving transport chain (93), is provided, the transfer wheel (92) and the transport chain (93) being arranged in an offset manner in the axial direction with respect to one another in two different planes that are parallel to one another, hollow objects (01) printed during ongoing production being transferred from the rotating transfer wheel (92) to the revolving transport chain (93), a second drive being provided, by which an axial position of the transfer wheel (92) relative to the position of the transport chain (93) can be changed automatically, whereby the offset in the axial direction between the transfer wheel (92) and the transport chain (93) is adaptable to the height of the hollow objects (01) to be printed in the second production.

15. The device according to claim 14, characterized in that a conveyor device (74) sequentially feeding a plurality of hollow objects (01) to be printed to the mandrel wheel (02) is provided, the conveyor device (74) comprising at least two elements that are spaced apart from one another and that each guide these hollow objects (01), these elements guiding the head and the bottom of the relevant hollow objects (01), a third drive being provided, by which the distance between elements of the conveyor device (74), which each guide the head and the bottom of the relevant hollow objects (01), can be changed automatically, whereby this distance is adaptable to the height of the hollow objects (01) to be printed in the second production.

16. The device according to claim 13, characterized in that a coating unit (88) for coating the outer lateral surface of the printed hollow objects (01) is provided, the coating unit (88) comprising at least one coating applicator roller (89), the relevant coating applicator roller (89) with a coating-applying surface being set, or at least being settable, against the lateral surface of at least one of the printed hollow objects (01) held by the expanding mandrels of the mandrel wheel (02), a fourth drive being provided, by which the position of the axial extension, extending parallel to the axis of rotation of the relevant coating applicator roller (89), of the coating-applying surface of this coating applicator roller (89) can be brought into congruent agreement with the height of the hollow objects (01) to be coated in the second production.

17. The device according to claim 13, characterized in that all these drives are in each case controlled by the control unit (82) as a function of stored settings, which are in each case based on a format of the hollow objects (01) to be printed and/or to be coated, these settings being stored in this control unit (82) and/or in a database (72) that has a data connection to this control unit (82).

18. The device according to claim 13, characterized in that an adjustment path of the transfer wheel (92) for adapting the offset in the axial direction between the mandrel wheel (02) and the transfer wheel (92), and/or for adapting the offset in the axial direction between the transfer wheel (92) and the transport chain (93), in each case to the height of the hollow objects (01) to be printed in the second production, and/or an adjustment path for modifying the distance between elements of the conveyor device (74), which each guide the head and the bottom of the relevant hollow objects (01), and/or an adjustment path for changing the position of the axial extension, extending parallel to the axis of rotation of the relevant coating applicator roller (89), of the coating-applying surface of this coating applicator roller (89) are in each case linear, these adjustment paths in each case extending lengthwise along the height of the hollow objects (01) to be printed and/or to be coated.

19. The device according to claim 13, characterized in that the hollow objects (01) conveyed by the conveyor device (74) or held by the expanding mandrels of the mandrel wheel (02) or transported by the transfer wheel (92) or by the transport chain (93) are in each case arranged lying flat along their transport path.

* * * * *